US006641345B2

(12) United States Patent
Cobene, II et al.

(10) Patent No.: US 6,641,345 B2
(45) Date of Patent: Nov. 4, 2003

(54) SYSTEMS AND METHODS OF INCREASING BINDING STRENGTH OF A BOUND TEXT BODY

(75) Inventors: Robert L. Cobene, II, San Jose, CA (US); Steven W Trovinger, Los Altos, CA (US); Christopher A Schantz, Redwood City, CA (US); Raymond G. Schuder, Menlo Park, CA (US); John P Ertel, Portola Valley, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 104 days.

(21) Appl. No.: 09/728,003

(22) Filed: Dec. 1, 2000

(65) Prior Publication Data

US 2002/0067977 A1 Jun. 6, 2002

(51) Int. Cl.[7] ..... B42B 9/00; B42B 5/00; B42B 5/08; B42B 5/10; B42C 5/00

(52) U.S. Cl. ..... 412/1; 412/6; 412/8; 412/20; 412/25; 412/28; 412/29; 412/32; 412/33; 412/37; 412/38; 412/39; 412/900; 412/902

(58) Field of Search ..... 412/1, 6, 8, 20, 412/25, 28, 29, 32, 33, 37, 38, 39, 900, 902

(56) References Cited

U.S. PATENT DOCUMENTS

| | | | | | |
|---|---|---|---|---|---|
| 2,090,796 | A | * | 8/1937 | Kitcat | 281/23 |
| 3,228,710 | A | * | 1/1966 | Chodorowski | 281/38 |
| 3,292,951 | A | * | 12/1966 | Schoenberger | 281/21 |
| 3,956,057 | A | * | 5/1976 | Jung | 281/21.1 |
| 3,980,514 | A | * | 9/1976 | Rosette et al. | 156/578 |
| 4,106,148 | A | * | 8/1978 | Axelrod | 281/21.1 |
| 4,408,780 | A | | 10/1983 | Detterman et al. | |
| 4,496,617 | A | | 1/1985 | Parker | |
| 4,588,470 | A | * | 5/1986 | Abegglen | 156/578 |
| 4,750,956 | A | * | 6/1988 | Malachowski | 412/37 |
| 4,911,475 | A | | 3/1990 | Lerman | |
| 4,951,967 | A | * | 8/1990 | Michalik | 281/21.1 |
| 4,960,295 | A | * | 10/1990 | Bodouroglou | 281/21.1 |
| 4,984,949 | A | | 1/1991 | Reckziegel | |
| 5,013,200 | A | | 5/1991 | Hunder et al. | |
| 5,152,654 | A | | 10/1992 | Luhman et al. | |
| 5,250,318 | A | * | 10/1993 | Tooker | 412/37 |
| 5,271,794 | A | | 12/1993 | Jarrell et al. | |
| 5,316,424 | A | | 5/1994 | Luhman et al. | |
| 5,346,350 | A | | 9/1994 | Luhman et al. | |
| 5,536,044 | A | | 7/1996 | Luhman et al. | |
| 5,605,575 | A | * | 2/1997 | Anderson | 412/37 |
| 5,833,423 | A | | 11/1998 | Yamaguchi et al. | |
| 5,871,323 | A | * | 2/1999 | Clark | 412/19 |
| 5,961,268 | A | * | 10/1999 | Jager | 412/1 |
| 6,000,894 | A | | 12/1999 | Suzuki et al. | |
| 6,053,684 | A | * | 4/2000 | Eckert et al. | 412/29 |
| 6,142,721 | A | * | 11/2000 | Marsh | 412/17 |
| 6,193,458 | B1 | * | 2/2001 | Marsh | 412/19 |
| 6,250,868 | B1 | * | 6/2001 | Schmucker | 412/25 |
| 2002/0106264 | A1 | * | 8/2002 | Cobene et al. | 412/1 |

FOREIGN PATENT DOCUMENTS

| | | |
|---|---|---|
| WO | WO 99/38707 | 8/1999 |

* cited by examiner

*Primary Examiner*—Andrea Wellington
*Assistant Examiner*—Mark T. Henderson

(57) ABSTRACT

Systems and methods are described for increasing the binding strength of a bound text body by increasing the spinal surface area exposed for adhesive penetration greater than an area corresponding to the product of the sheet height dimension, the sheet thickness dimension and the number of sheets. In one aspect, sheet-wise conditioning of the binding area is performed prior to the application of adhesive to increase the bond area between sheets of the text body. In another aspect, the spinal surface area exposed for adhesive penetration is increased as adhesive is applied.

18 Claims, 7 Drawing Sheets

SYSTEMS AND METHODS OF INCREASING BINDING STRENGTH OF A BOUND TEXT BODY

CROSS-REFERENCE TO RELATED APPLICATIONS

Under 35 U.S.C. §120 this application claims the benefit of co-pending U.S. patent application Ser. No. 09/721,549, filed Nov. 24, 2000, by Robert L. Cobene et al., and entitled "SYSTEMS AND METHODS OF ATTACHING A COVER TO A TEXT BODY" which is incorporated herein by reference.

TECHNICAL FIELD

This invention relates to systems and methods of increasing the binding strength of a bound text body.

BACKGROUND

Today, a variety of different bookbinding systems can deliver professionally bound documents, including books, manuals, publications, annual reports, newsletters, business plans, and brochures. A bookbinding system generally may be classified as a commercial (or trade) bookbinding system that is designed for in-line manufacturing of high quality volume runs or an in-house (or office) bookbinding system designed for short "on-demand" runs. Commercial bookbinding systems generally provide a wide variety of binding capabilities, but require large production runs (e.g., on the order of thousands of bindings) to offset the set-up cost of each production run and to support the necessary investment in expensive in-line production equipment. Office bookbinding systems, on the other hand, generally involve manual intervention and provide relatively few binding capabilities, but are significantly less expensive to set up and operate than commercial bookbinding systems, even for short on-demand production runs of only a few books.

In general, a bookbinding system collects a plurality of sheets (or pages) into a text body (or book block) that includes a spine and two side hinge areas. The bookbinding system applies an adhesive to the text body spine to bind the sheets together. A cover may be attached to the bound text body by applying an adhesive to the side hinge areas or the spine of the text body, or both. The cover of a typical commercial soft cover book generally is attached to the text spine. The covers of hardcover books and some soft cover "lay flat" books, on the other hand, typically are not attached to the text body spines (i.e., the spines are "floating").

Many different systems have been proposed for applying adhesive to a text body spine to bind the text body sheets together.

For example, U.S. Pat. No. 5,346,350 discloses an apparatus for binding sheets that includes an aligning plate that aligns the sheets edges at the spine edge, and two clamping plates that hold the sheets during binding. A heating platen heats and melts a backless solid hot melt adhesive that is placed along the sheet edges. The hot melt adhesive binds the sheets together at the spinal area. According to the '350 patent:

Capillary action is the preferred primary mechanism by which the adhesive flows into the stack 12 to bond the paper sheets together. Capillary action assists both the adhesion of the adhesive material 94 to the stack of paper 12 and the internal cohesion within the adhesive material 94.

Additionally, the platen 120 of the heating subsystem 118 does not push the adhesive 94 into the edge 13 of the stack 12. Ideally, the platen 120 applies zero pressure against the stack 12 and only contacts the adhesive material sheet 94 sufficiently to melt the adhesive 94 so that the gravity-assisted capillary action causes the liquid adhesive 94 to wick into and bond the stack 12 together. Putting pressure on the adhesive 94 in an attempt to push it into the stack 12, whether pushing downwardly, upwardly, or sideways, would not enhance bonding. Rather, this would squeeze the adhesive off of the edge 13 and off of the stack 12 through the sides between the platen 120 and the stack 12 and defeat the effects of capillary action. Thus, the platen is designed to apply only minimal pressures on the edge 13 of the stack 12 to maintain contact between the platen 120, the adhesive 94 and the stack 12.

(Col. 8, line 60 through col. 9, line 29)

The hot melt adhesive also may be used to attach a preformed book cover to the text body spine.

International Patent Publication No. WO 99/38707 discloses a paperback bookbinding scheme in which a cover with an adhesive strip disposed along a spine area is forced between a pair of pressing rollers to form a pocket, and a text body is inserted into the pocket with the text body spine in contact with the adhesive strip. The pressing rollers are moved forcibly toward one another to compress the cover firmly against the front and back sides of the text body and to compress the text body sheets together tightly in the area adjacent to the spine. A sonic tool transmits sonic energy to the cover to activate the adhesive strip and, thereby, bind the text body sheets and the cover into a perfectly bound book.

U.S. Pat. No. 4,911,475 discloses a bookbinding construction in which sheets are bound together into a book block by two or more spaced-apart transverse segments of adhesive. The front section of a cover is attached to the first page of the book block and the back section of the cover is secured to the last page of the book block. Upon opening the book or turning a page, glue-free portions of the spine edge of the open page flex or bow outward over the facing page in a wedging manner or interfering fit. According to the '475 patent, this wedging action against the opposite page resists the tendency of the book to spring closed and forces the pages of the book to lie flat.

U.S. Pat. No. 5,271,794 discloses an adhesive applicator that is configured to spread coat an adhesive onto the spine and side edges of a text body to bind the text body sheets and a cover into a perfectly bound book with an attached spine. The adhesive applicator includes a book spine coating nozzle with adjustable side sealing jaws for adjusting the nozzle width for different book thicknesses and separate side glue outlets for depositing glue on the book sides. Glue flow control valves are disposed between the spine coating nozzle and the side glue outlets so the glue deposited on the book sides may be selectively and independently cut off or controlled.

Still other bookbinding systems have been proposed.

SUMMARY

The invention features novel systems and methods of increasing the binding strength of a bound text body.

In one aspect, the invention features a method of binding sheets into a bound text body in accordance with which a text body is formed from a number of sheets characterized by a height dimension and a thickness dimension. An adhesive is applied to a spine of the text body to bind the sheets into a bound text body. The text body has a surface area exposed for adhesive penetration that is greater than an area corresponding to the product of the sheet height dimension, the sheet thickness dimension and the number of sheets.

Embodiments in accordance with this aspect of the invention may include one or more of the following features.

The text body may be formed by registering the sheets with respect to two datum edges so that variations in sheet width dimension are accommodated in the spine of the text body.

In some embodiments, the text body is formed by processing sheets to increase the surface area exposed for adhesive penetration along the spine of the text body. The sheets may be processed by embossing sheet edges corresponding to the spine of the text body, and the sheets preferably are collected in a sequence with alternate sheets embossed at the spine end of the text body. The sheets may be processed by forming sheets with non-linear edges at the spine of the text body. The non-linear sheet edges may be characterized by periodic variations along the spine of the text body. The text body may be formed by collecting sheets in a sequence and sheets may be processed by forming adjacent sheets with different width dimensions. The sheets may be processed by perforating sheets along respective fold lines corresponding to the spine of the text body and folding sheets along the fold lines.

In some embodiments, the sheets are processed by separating adjacent sheets as adhesive is applied to the spine of the text body. Adjacent sheets may be separated by clamping the text body at one or more locations near the spine of the text body. Adjacent sheets may be separated by applying across the spine of the text body a force directed along a thickness dimension of the text body. The force may be applied by a flow of air directed across the spine edge of the text body or by a rotary mechanism. Adjacent sheets also may be separated by applying to the adhesive a force driving adhesive between adjacent sheets.

In another aspect of the invention, a system for binding sheets into a bound text body includes a sheet collector and an adhesive applicator. The sheet collector is configured to form a text body from a number of sheets characterized by a height dimension and a thickness dimension. The text body has a surface area exposed for adhesive penetration that is greater than an area corresponding to the product of the sheet height dimension, the sheet thickness dimension and the number of sheets. The adhesive applicator is configured to apply to a spine of the text body an adhesive for binding the sheets into a bound text body.

Embodiments in accordance with this aspect of the invention may include one or more of the following features.

The sheet collector may be configured to register the sheets with respect to two datum edges so that variations in sheet width dimension are accommodated in the spine edge of the text body.

The sheet collector may be configured to process sheets to increase the surface area exposed for adhesive penetration along the spine of the text body. For example, the sheet collector may be configured to emboss sheet edges corresponding to the spine end of the text body. In some embodiments, the sheet collector is configured to separate adjacent sheets as adhesive is applied to the spine of the text body.

Other features and advantages of the invention will become apparent from the following description, including the drawings and the claims.

DETAILED DESCRIPTION

In the following description, like reference numbers are used to identify like elements. Furthermore, the drawings are intended to illustrate major features of exemplary embodiments in a diagrammatic manner. The drawings are not intended to depict every feature of actual embodiments nor relative dimensions of the depicted elements, and are not drawn to scale.

Figure 1:
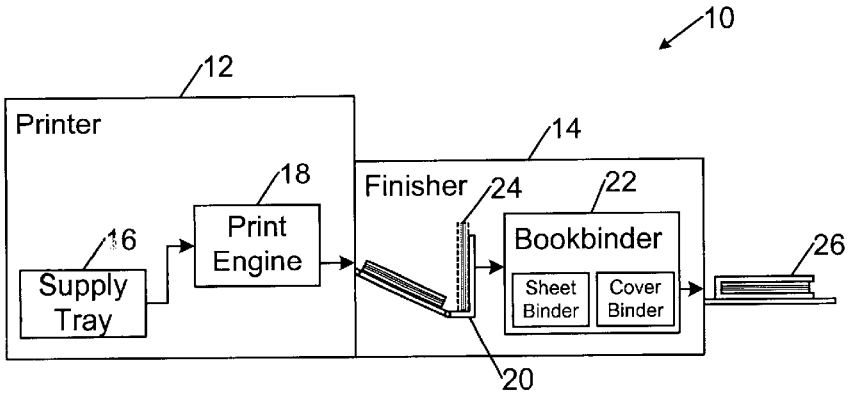
FIG. 1 is a diagrammatic side view of a bookbinding system.

Referring to FIG. 1, in one embodiment, a bookbinding system 10 includes a printer 12 and a finisher 14. Bookbinding system 10 may be implemented as a desktop or office bookmaking system designed to satisfy on-demand bookbinding needs. Printer 12 may be a conventional printer (e.g., a LaserJet® printer available from Hewlett-Packard Company of Palo Alto, Calif., U.S.A.) that includes a supply tray 16 that is configured to hold a plurality of sheets (e.g., paper sheets), and a print engine 18 that is configured to apply markings onto the sheets received from supply tray 16. Finisher 14 includes a sheet collector 20 and a bookbinder 22. Bookbinder 22 includes a sheet binder that is configured to bind the text body sheets to one another, and a cover binder that is configured to attach a cover to the bound text body. In operation, sheets are fed from supply tray 16 to print engine 18, which prints text, pictures, graphics, images and other patterns onto the sheets. The printed sheets are fed to sheet collector 20, which collects and aligns the sheets into a text body 24 with an exposed spine bounded by two exposed side hinge areas. The text body 24 is conveyed to bookbinder 22. The sheet binder binds the sheets of text body 24, and the cover binder attaches a cover to the bound text body to produce a bound book 26 with a floating or attached spine.

Figure 2:
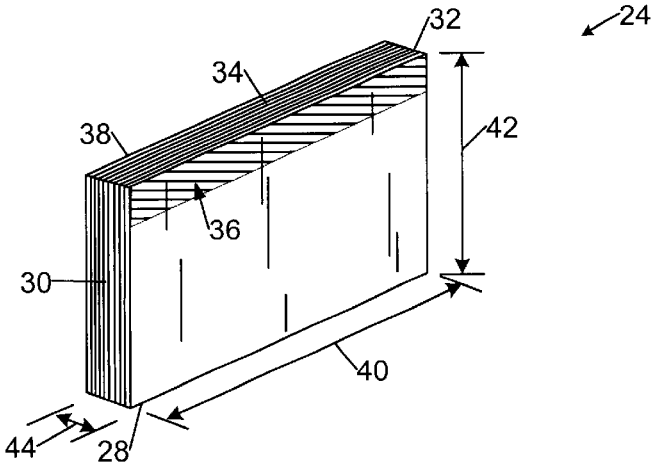
FIG. 2 is a diagrammatic perspective view of a text body formed by collecting and aligning a plurality of sheets.
Figure 3:
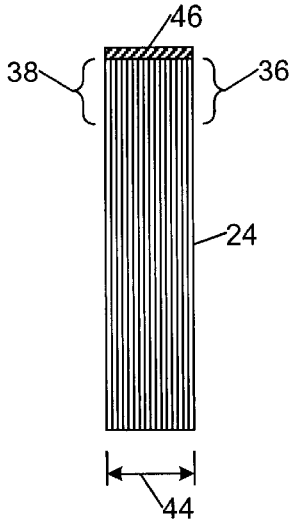
FIG. 3 is a diagrammatic end view of the text body of FIG. 2 bound by a hot melt adhesive applied to the text body spine.

As shown in FIGS. 2 and 3, text body 24 includes a plurality of sheets and is characterized by a front end 28, two sides 30, 32 and a spinal area (or spine) 34, which is located opposite to front end 28. Spine 34 is bounded by two side hinge areas 36, 38. Text body 24 may be characterized by a height dimension 40, a width dimension 42, and a thickness dimension 44. In one embodiment, height dimension 40 and thickness dimension 44 are measured. A hot melt adhesive 46 is pre-formed, applied to the text body spine 34, and heated to a temperature at or above the melting temperature of the adhesive. The melted adhesive conforms to the exposed surface features of spinal area 34 and flows into spaces between the edges of the sheets by capillary action. Upon cooling, hot melt adhesive 46 re-solidifies and binds the sheets into a bound text body. A variety of different hot melt adhesive compositions may be used to bind the text body sheets, including a conventional paper-backed hot melt sheet adhesive that may be dispensed from a roll.

Figure 4:
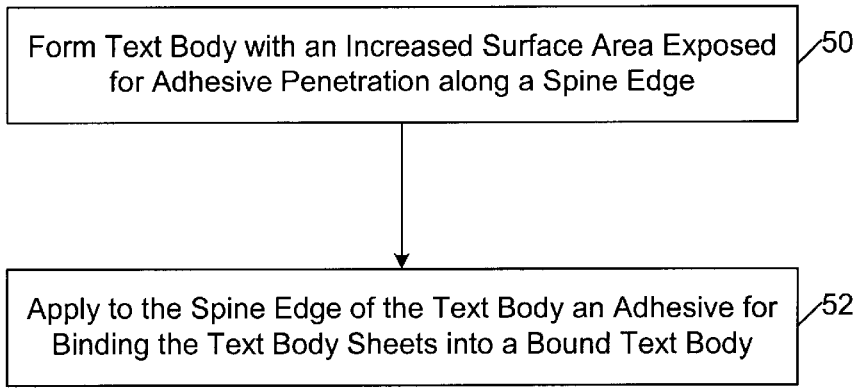
FIG. 4 is a flow diagram of a method of binding sheets into a bound text body.

Referring to FIG. 4, bookbinding system 10 may incorporate one or more systems and methods for increasing the binding strength of a bound text body. In particular, bookbinding system 10 is configured to form text body 24 with an increased surface area exposed for adhesive penetration along spine edge 34 (step 50). The resulting text body 24 has a surface area exposed for adhesive penetration that is greater than an area corresponding to the product of the sheet height dimension, the sheet thickness dimension and the number of sheets in text body 24. Bookbinding system 10 binds the sheets together by applying an adhesive to the spine edge of the text body (step 52). In the following embodiments, the spinal area exposed for adhesive penetration may be increased by preparing the text body sheets before adhesive is applied to the text body spine 34 or by separating the ends of the sheets near the spine edge as adhesive is applied to the text body spine 34.

Preparing Sheets Before Application of Adhesive

Figure 5A:
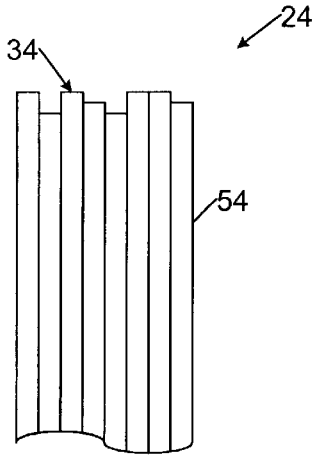
FIG. 5A is a diagrammatic end view of a text body formed by registering sheets with respect to two datum edges so that variations in sheet width dimension are accommodated in the spine edge of the text body.
Figure 5B:
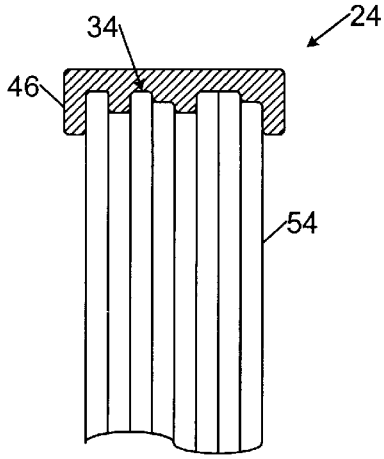
FIG. 5B is a diagrammatic end view of the text body of FIG. 5A bound by a hot melt adhesive applied to the text body spine.

Referring to FIGS. 5A and 5B, in one embodiment, the spinal area exposed for adhesive penetration may be increased before adhesive is applied by registering and aligning text body sheets 54 with respect to two datum edges. In particular, the sheets preferably are aligned with reference to front end 28 of text body 24 and one of the two text body sides 30, 32 so that variations in sheet dimensions are accommodated in the text body width dimension 42 of spinal area 34. As a result, the spinal surface area exposed for adhesive penetration is greater than if all of the sheets 54 were registered and aligned with respect to spine edge 34. As shown in FIG. 5B, after pre-formed hot melt adhesive 46 is applied to the text body spine 34 and heated to a temperature at or above the melting temperature of the adhesive, the melted adhesive conforms to the exposed surface features of spinal area 34 and flows into spaces between the ends of sheets 54. Upon cooling, hot melt adhesive 46 re-solidifies and binds the sheets 54 into a bound text body. The resulting bonds between text body sheets 54 are greater than bonds between sheets registered and aligned at spine edge 34.

Figure 6A:
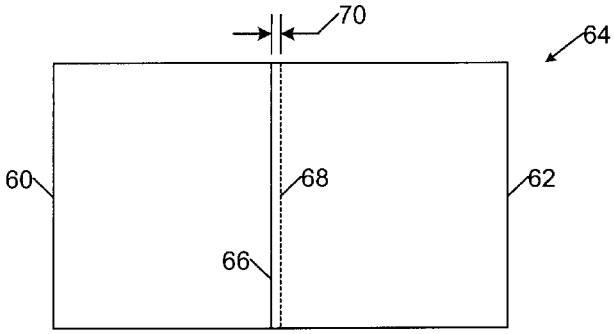
FIG. 6A is a diagrammatic top view of a sheet stock with a cut line offset from a centerline of the sheet stock.
Figure 6B:
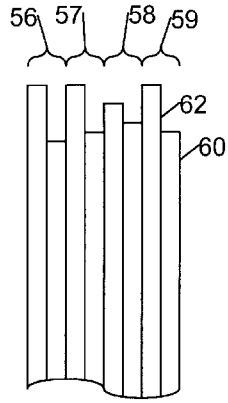
FIG. 6B is a diagrammatic end view of a text body formed from sheets cut from the sheet stock of FIG. 6A.

As shown in FIGS. 6A and 6B, the spinal area exposed for adhesive penetration may be increased further in the text body width dimension 42 by forming adjacent sheets with different width dimensions. In particular, pairs 56, 57, 58, 59 of adjacent sheets 60, 62 may be formed from the same sheet stock 64 by cutting sheet stock 64 along a line 66 that is offset from the centerline 68 by a selected offset distance 70. As a result, adjacent sheets 60, 62 have width dimensions that differ by twice the offset distance 70. For example, offset distance 70 may be 0.1 mm, in which case adjacent sheets 60, 62 would differ in width by approximately 0.2 mm. Text body 24 is formed by collecting pairs 56–59 of adjacent sheets 60, 62 in sequence. As a result, the spinal area exposed for adhesive penetration is increased.

Figure 7A:
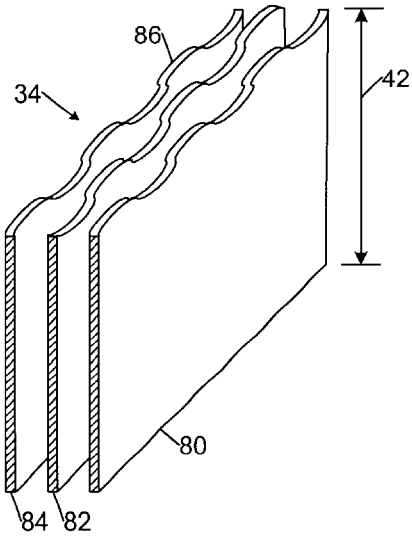
FIG. 7A is a diagrammatic perspective view of three text body sheets with periodic non-linear variations at the spine edge.
Figure 7B:
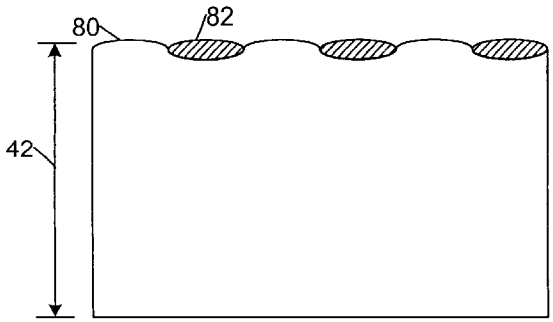
FIG. 7B is a diagrammatic side view of a text body formed from the sheets of FIG. 7A.

Referring to FIGS. 7A and 7B, in another embodiment, the spinal area exposed for adhesive penetration also may be increased in the text body width dimension 42 by forming sheets 80, 82, 84 with non-linear edges at the text body spine. In one embodiment, the non-linear sheet edges are characterized by periodic variations 86 at the spine edge 34. The periodic spine edge variations 86 may have any form of repeating pattern, including any sinusoidal (as shown), polygonal or elliptical patterns. The text body sheets preferably are collected in a sequence with the periodic spine edge variations 86 of adjacent sheets (i.e., 80, 82 and 82, 84) 180° out-of-phase (as shown) to increase the spinal surface area exposed for adhesive penetration.

Figure 8A:
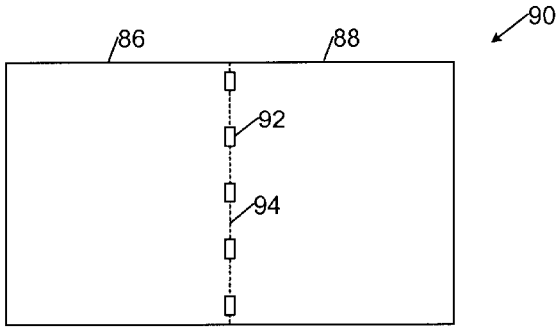
FIG. 8A is a diagrammatic top view of a sheet stock with a plurality of perforations along a centerline of the sheet stock.
Figure 8B:
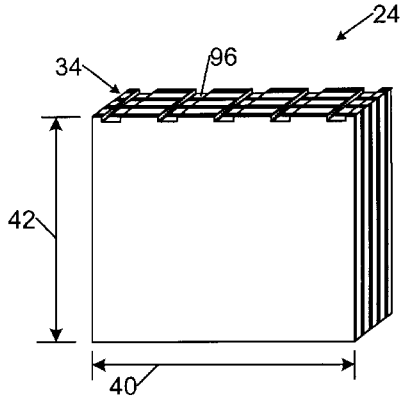
FIG. 8B is a diagrammatic perspective view of a text body formed from a number of sheets of FIG. 8A that are folded along the centerline.

As shown in FIGS. 8A and 8B, in another embodiment, the spinal area exposed for adhesive penetration may be increased in the text body width dimension 42 by forming adjacent text body sheets 86, 88 from a sheet stock 90 that includes a plurality of perforations 92 along a fold line 94 corresponding to the text body spine edge 34. Perforations 92 may have any shape, including any polygonal (e.g., rectangular, as shown) or elliptical shapes. A number of folded sheets 90 may be collected and aligned with respect to the perforations 92 to form text body 24. The perforations 92 form a series of grooves 96 that are oriented across the text body thickness dimension 44. As a result, the spinal area exposed for adhesive penetration is increased.

Figure 9A:
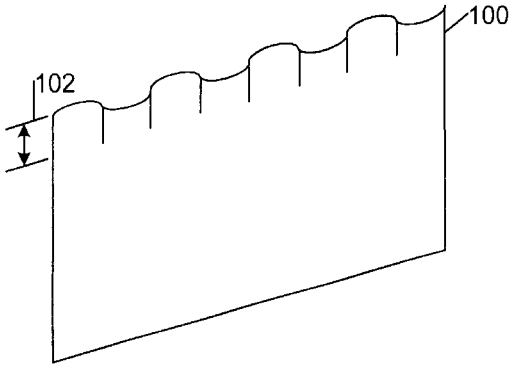
FIG. 9A is a diagrammatic perspective view of a sheet that is embossed at the spine edge.
Figure 9B:
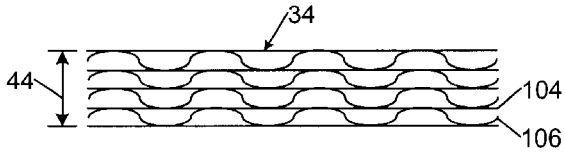
FIG. 9B is a diagrammatic top view of a text body formed by collecting sheets in a sequence of un-embossed sheets interposed between the embossed sheets of FIG. 9A.

Referring to FIGS. 9A and 9B, in one embodiment, the spinal area exposed for adhesive penetration may be increased in the text body thickness dimension 44 by embossing sheet edges corresponding to the text body spine edge 34. As a result, the embossed sheets have a corrugated region 100 that extends a selected distance 102 (e.g., 0.1–1 mm) from the text body spine 34. The embossing pattern may be any form of repeating variation in the text body thickness dimension 44, including any sinusoidal (as shown), polygonal or elliptical pattern. Text body 24 is formed by collecting sheets in a sequence with un-embossed sheets 104 interposed between embossed sheets 106. After pre-formed hot melt adhesive is applied to the text body spine 34 and heated to a temperature at or above the melting temperature of the adhesive, the melted adhesive conforms to the exposed surface features of spinal area 34 and flows into spaces between the ends of sheets 104 and 106. Before cooling, text body 24 may be compressed in the corrugated region 100 to reduce thickness dimension 44 of text body 24 near spine edge 34. Subsequently, the hot melt adhesive re-solidifies to bind the sheets into a bound text body.

Separating Sheets During Adhesive Application

Figure 10A:
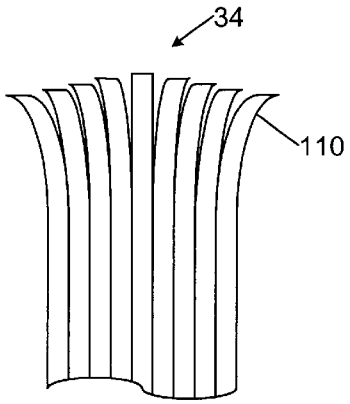
FIG. 10A is a diagrammatic end view of the spine of a text body with sheets separated at the spine edge.
Figure 10B:
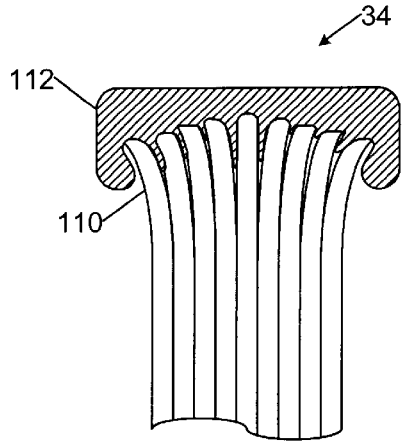
FIG. 10B is a diagrammatic end view of the text body spine of FIG. 10A bound by a hot melt adhesive applied to the text body spine.

As shown in FIGS. 10A and 10B, in some embodiments, the spinal area exposed for adhesive penetration may be increased by separating sheet ends 110 near text body spine 34 in the text body thickness dimension 44 as adhesive is applied to the text body spine 34. An adhesive 112 may be applied to the text body spine 34 in a pre-formed state or a molten state. With or without additional processing, the adhesive conforms to the exposed surface features of spinal area 34 and flows into spaces between the ends of the separated sheets. Upon cooling, adhesive 112 re-solidifies to bind the sheets into a bound text body (FIG. 10B).

Figure 11A:
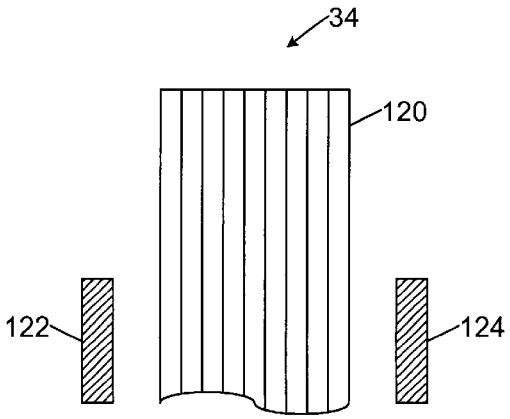
FIG. 11A is a diagrammatic end view of a text body spine and a pair of clamps.
Figure 11B:
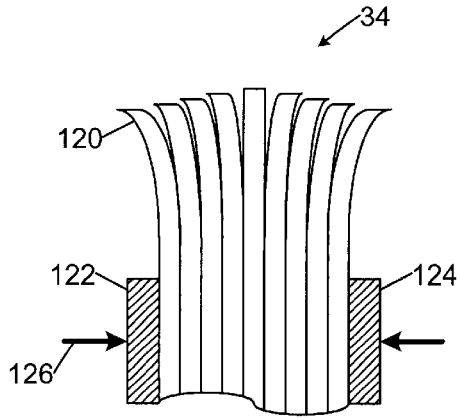
FIG. 11B is a diagrammatic end view of the text body of FIG. 11A being compressed near the spine edge by the pair of clamps.

Referring to FIGS. 11A and 11B, in one embodiment, sheet ends 120 near text body spine 34 may be separated in the text body thickness dimension 44 by compressing text body 24 at one or more locations near spine edge 34 between a pair of clamps (or compression rollers) 122, 124. Clamps 122, 124 preferably apply a force 126 across the text body thickness dimension 44 that is sufficient to separate sheet ends 120. Clamps 122, 124 may release text body 24 after the applied adhesive has re-solidified to bind the sheets into a bound text body.

Figure 12A:
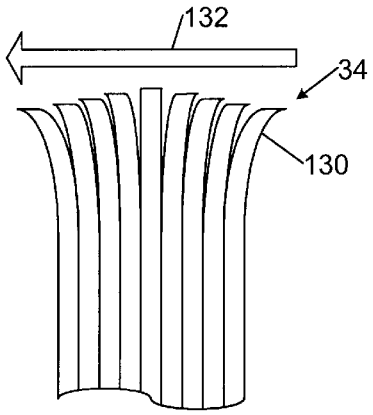
FIG. 12A is a diagrammatic end view of a text body spine and a flow of air applied across the spine edge of the text body sheets.
Figure 12B:
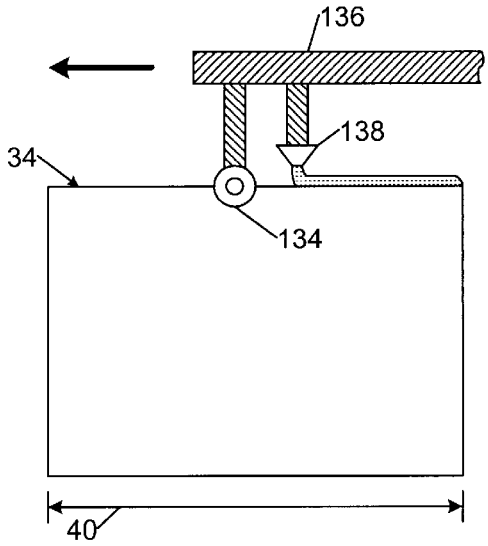
FIG. 12B is a diagrammatic side view of an adhesive applicator applying an adhesive along the spine edge of FIG. 12A.

Referring to FIGS. 12A and 12B, in another embodiment, sheet ends 130 near text body spine 34 may be separated in the text body thickness dimension 44 by directing a flow of air 132 across spine edge 34. The flow of air 132 may be directed at sheet edges 130 from an air jet nozzle 134, which is attached to a support mechanism 136 that is configured to carry air jet nozzle 134 from one end of text body spine 34 to the other. Support mechanism 136 also is configured to carry an adhesive dispenser 138 behind air jet nozzle 134. The velocity of air flow 132, the distance separating air jet nozzle 134 and spine edge 34, the distance separating air jet nozzle 134 and adhesive dispenser 138, and the speed at which support mechanism 136 moves along spine edge 34 may be varied to achieved a desired level of adhesive penetration into spine edge 34.

Figure 13A:
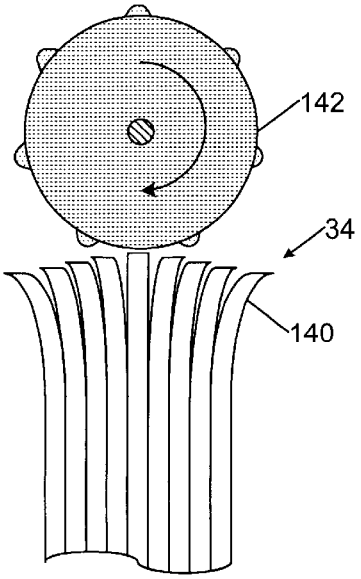
FIG. 13A is a diagrammatic end view of a text body spine and a rotary mechanism applying a force across the thickness dimension of the text body.
Figure 13B:
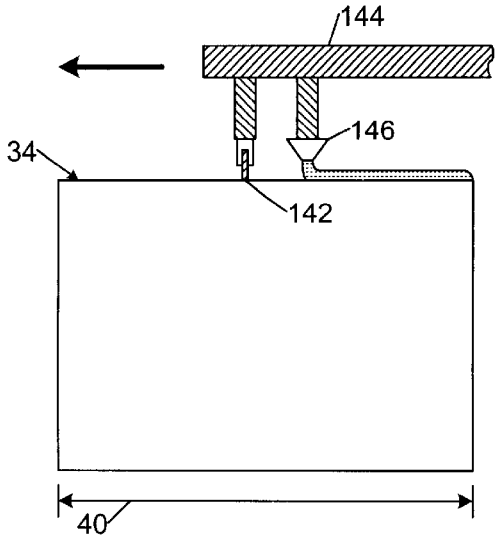
FIG. 13B is a diagrammatic side view of an adhesive applicator applying an adhesive along the spine edge of FIG. 13A.

Referring to FIGS. 13A and 13B, in another embodiment, sheet edges 140 near text body spine 34 may be separated in the text body thickness dimension 44 by a rotary mechanism 142. Rotary mechanism 142 may be in the form of a rotary wheel (or gear, as shown) or a rotary belt, which is attached to a support mechanism 144 that is configured to carry rotary mechanism 142 from one end of text body spine 34 to the other. In some embodiments, rotary mechanism 142 may be swept back-and-forth across the text body thickness dimension as rotary mechanism 142 is conveyed along text body spine 34. Support mechanism 144 also is configured to carry an adhesive dispenser 146 behind rotary mechanism 142. The rotation rate of rotary mechanism 142, the depth of penetration of rotary mechanism 142 into spine edge 34, the distance separating rotary mechanism 142 and adhesive dispenser 146, and the speed at which support mechanism 144 moves along spine edge 34 may be varied to achieved a desired level of adhesive penetration into spine edge 34.

Figure 14A:
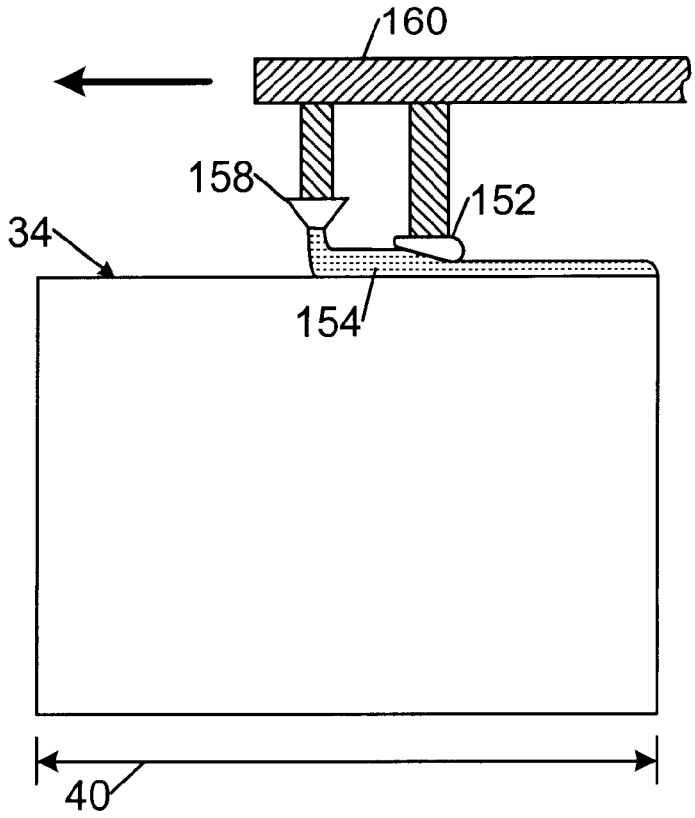
FIG. 14A is a diagrammatic side view of an adhesive applicator applying an adhesive along the spine edge of a text body and an adhesive spreader applying to the applied adhesive a force driving adhesive between adjacent sheets.
Figure 14B:
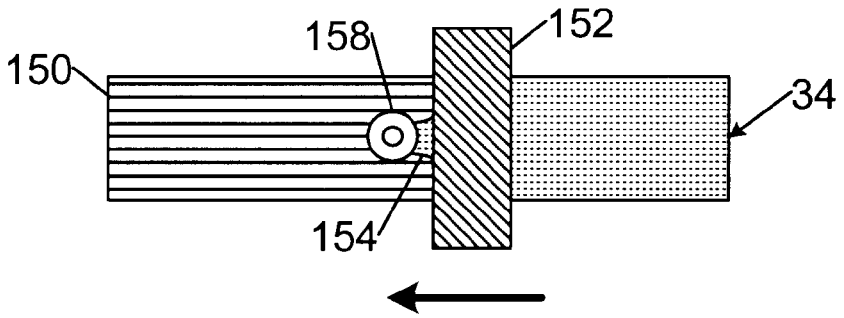
FIG. 14B is a diagrammatic top view of the adhesive applicator and adhesive spreader of FIG. 14A.

Referring to FIGS. 14A and 14B, in another embodiment, sheet ends 150 near text body spine 34 may be separated in the text body thickness dimension 44 by a heated adhesive spreader 152. Adhesive spreader 152 is configured to spread across the thickness of spine 34 adhesive 154 that is applied to text body spine 34 by an adhesive dispenser 158. Adhesive spreader 152 also is configured to apply to adhesive 154 a normal force driving adhesive 154 between adjacent sheets of text body 24. Adhesive spreader 152 and adhesive dispenser 158 are carried by a support mechanism 160 that is moved from one end of text body spine 34 to the other. The temperature to which adhesive spreader 152 is heated, the distance between adhesive spreader 152 and spine edge 34, the distance separating adhesive spreader 152 and adhesive dispenser 158, and the speed at which support mechanism 160 moves along spine edge 34 may be varied to achieved a desired level of adhesive penetration into spine edge 34.

In sum, the above-described embodiments incorporate novel systems and methods for increasing the binding strength of a bound text body in a manner that may improve the performance and cost-effectiveness of desktop and office on-demand bookbinding systems.

Other embodiments are within the scope of the claims. For example, other embodiments may combine features of two or more of the above-described embodiments to increase the spinal surface area exposed for adhesive penetration and, thereby, increase the binding strength of a bound text body.

What is claimed is:

1. A method of binding sheets into a bound text body, comprising:

sequentially modifying a number of sheets characterized by a height dimension and a thickness dimension, with adjacent sheets being modified differently, and collecting modified sheets into a text body having a spine so that adjacent sheets have different features at the text body spine that collectively increase spinal surface area exposed for adhesive penetration greater than an area corresponding to a multiplication of the sheet height dimension, the sheet thickness dimension and the number of sheets;

applying to the text body spine a preformed hot melt adhesive; and melting the preformed hot melt adhesive so that the melted adhesive conforms to the exposed surface area of the text body spine to bind the sheets into a bound text body.

2. The method of claim 1, further comprising registering the sheets with respect to two datum edges so that variations in sheet width dimension are accommodated in the spine of the text body.

3. The method of claim 1, wherein sheets are modified by embossing sheet edges corresponding to the spine of the text body.

4. The method of claim 1, wherein sheets are modified by forming non-linear sheet edges at the spine of the text body.

5. The method of claim 1, wherein sheets are modified by forming adjacent sheets with different width dimensions.

6. The method of claim 3, wherein alternate sheets are embossed at the spine of the text body, and embossed sheets are disposed adjacent to unembossed sheets in the text body.

7. The method of claim 4, wherein non-linear sheet edges are characterized by periodic variations along the spine of the text body.

8. A method of binding sheets into a bound text body, comprising:

sequentially modifying a number of sheets characterized by a height dimension and a thickness dimension and collecting modified sheets into a text body having a surface area exposed for adhesive penetration greater than an area corresponding to a multiplication of the sheet height dimension, the sheet thickness dimension and the number of sheets, wherein sheets are modified by perforating sheets along respective fold lines corresponding to a spine of the text body and folding sheets along the fold lines to increase the surface area exposed for adhesive penetration along the spine of the text body; and applying to the spine of the text body an adhesive for binding the sheets into a bound text body.

9. A method of binding sheets into a bound text body, comprising:

forming from a number of sheets characterized by a height dimension and a thickness dimension a text body having a spine with a surface area exposed for adhesive penetration that is greater than an area corresponding to a multiplication of the sheet height dimension, the sheet thickness dimension and the number of sheets; and applying to the text body spine an adhesive for binding the sheets into a bound text body; and separating adjacent sheets as adhesive is applied to the text body spine by applying across the spine of the text body a force directed along the thickness dimension of the text body, wherein the force is applied by a flow of air directed across the spine edge of the text body.

10. A method of binding sheets into a bound text body, comprising:

forming from a number of sheets characterized by a height dimension and a thickness dimension a text body having a spine with a surface area exposed for adhesive penetration that is greater than an area corresponding to a multiplication of the sheet height dimension, the sheet thickness dimension and the number of sheets; and applying to the text body spine an adhesive for binding the sheets into a bound text body; and separating adjacent sheets as adhesive is applied to the text body spine by applying across the spine of the text body a force directed along the thickness dimension of the text body, wherein the force is applied by a rotary mechanism.

11. A system for binding sheets into a bound text body, comprising:

a sheet collector configured to sequentially modify a number of sheets characterized by a height dimension and a thickness dimension, with adjacent sheets being modified differently, and to collect modified sheets into a text body having a spine so that adjacent sheets have different features at the text body spine that collectively increase spinal surface area exposed for adhesive penetration greater than an area corresponding to a multiplication of the sheet height dimension, the sheet thickness dimension and the number of sheets;

an adhesive applicator configured to apply to the text body spine a preformed hot melt adhesive; and melting the preformed hot melt adhesive so that the melted adhesive conforms to the exposed surface area of the text body spine to bind the sheets into a bound text body.

12. The system of claim 11, wherein the sheet collector is configured to register the sheets with respect to two datum edges so that variations in sheet width dimension are accommodated in the spine of the text body.

13. The system of claim 11, wherein the sheet collector is configured to emboss sheet edges corresponding to the spine end of the text body.

14. The system of claim 11, wherein the sheet collector is configured to emboss alternate sheets at the spine of the text body and to dispose embossed sheets adjacent to unembossed sheets in the text body.

15. The system of claim 11, wherein the sheet collector is configured to form non-linear sheet edges at the spine of the text body.

16. The system of claim 11, wherein the sheet collector is configured to form adjacent sheets with different width dimensions.

17. A system for binding sheets into a bound text body, comprising:

a sheet collector configured to form from a number of sheets characterized by a height dimension and a thickness dimension a text body having a spine with a surface area exposed for adhesive penetration that is greater than an area corresponding to a multiplication of the sheet height dimension, the sheet thickness dimension and the number of sheets; and an adhesive applicator configured to apply an adhesive to the text body spine and to separate adjacent sheets as adhesive is applied to the text body spine by directing a force across the exposed surface area of the spine of the text body along the thickness dimension of the text body, wherein the adhesive applicator is configured to direct a flow of air across the spine edge of the text body.

18. A system for binding sheets into a bound text body, comprising:

a sheet collector configured to form from a number of sheets characterized by a height dimension and a thickness dimension a text body having a spine with a surface area exposed for adhesive penetration that is greater than an area corresponding to a multiplication of the sheet height dimension, the sheet thickness dimension and the number of sheets; and an adhesive applicator configured to apply an adhesive to the text body spine and to separate adjacent sheets as adhesive is applied to the text body spine by directing a force across the exposed surface area of the spine of the text body along the thickness dimension of the text body, wherein the adhesive applicator includes a rotary mechanism constructed and arranged to apply the force across the spine of the text body.

* * * * *